US010508569B2

(12) United States Patent
Adachi et al.

(10) Patent No.: US 10,508,569 B2
(45) Date of Patent: Dec. 17, 2019

(54) THERMAL ENERGY RECOVERY DEVICE

(71) Applicant: Kabushiki Kaisha Kobe Seiko Sho (Kobe Steel, Ltd.), Hyogo (JP)

(72) Inventors: Shigeto Adachi, Takasago (JP); Yutaka Narukawa, Takasago (JP); Kazumasa Nishimura, Takasago (JP)

(73) Assignee: Kabushiki Kaisha Kobe Seiko Sho (Kobe Steel, Ltd.), Hyogo (JP)

( * ) Notice: Subject to any disclaimer, the term of this patent is extended or adjusted under 35 U.S.C. 154(b) by 114 days.

(21) Appl. No.: 15/855,801

(22) Filed: Dec. 27, 2017

(65) Prior Publication Data

US 2018/0223700 A1 Aug. 9, 2018

(30) Foreign Application Priority Data

Feb. 9, 2017 (JP) ..... 2017-022219

(51) Int. Cl.
*F01K 23/02* (2006.01)
*F01K 13/02* (2006.01)

(52) U.S. Cl.
CPC ..... *F01K 23/02* (2013.01); *F01K 13/02* (2013.01)

(58) Field of Classification Search
CPC combination set(s) only.
See application file for complete search history.

(56) References Cited

U.S. PATENT DOCUMENTS

2010/0326076 A1 12/2010 Ast et al.
2013/0167533 A1 7/2013 Bruckner et al.
2014/0224469 A1 8/2014 Mirmobin et al.
2014/0311141 A1* 10/2014 Mori ..... F02G 5/00 60/599
2014/0373544 A1* 12/2014 Mohan ..... F01K 9/003 60/670

(Continued)

FOREIGN PATENT DOCUMENTS

EP 3118424 A1 1/2017
EP 3124755 A1 2/2017

(Continued)

OTHER PUBLICATIONS

Extended European Search Report issued by the European Patent Office dated Jul. 13, 2018, which corresponds to EP17208349.5-1008 and is related to U.S. Appl. No. 15/855,801.

*Primary Examiner* — Mark A Laurenzi
*Assistant Examiner* — Shafiq Mian
(74) *Attorney, Agent, or Firm* — Studebaker & Brackett PC

(57) ABSTRACT

Provided is a thermal energy recovery device in which a site of a circulation flow path between an evaporated portion and an expander can be avoided having too high temperature upon stoppage of power recovery by a power recovery machine. The thermal energy recovery device includes an evaporator (10), an expander (12), a power recovery machine (14), a condenser (16), a pump (18), a circulation flow path (20), a cooling flow path (30) for supplying working medium of liquid phase flowing out of the pump (18) partially to a site of the circulation flow path (20) between the evaporator (10) and the expander (12), an on-off valve (V1) provided in the cooling flow path (30), and a control unit (40), in which upon reception of a stop signal for stopping power recovery by the power recovery machine (14), the control unit (40) opens the on-off valve (V1).

4 Claims, 2 Drawing Sheets

(56) References Cited

U.S. PATENT DOCUMENTS

| | | | | |
|---|---|---|---|---|
| 2015/0107253 | A1* | 4/2015 | Haraguchi | F01K 13/02<br>60/660 |
| 2015/0285103 | A1* | 10/2015 | Tanaka | F01K 23/02<br>60/599 |
| 2016/0076405 | A1* | 3/2016 | Hashimoto | F01K 25/08<br>60/653 |
| 2018/0209307 | A1 | 7/2018 | Aumann et al. | |

FOREIGN PATENT DOCUMENTS

| | | | |
|---|---|---|---|
| JP | 2015-190364 | A | 11/2015 |
| WO | 2015/146403 | A1 | 10/2015 |

* cited by examiner

THERMAL ENERGY RECOVERY DEVICE

BACKGROUND OF THE INVENTION

Field of the Invention

The present invention relates to a thermal energy recovery device.

Description of the Related Art

There have conventionally been known thermal energy recovery devices for recovering power from exhaust heat from various types of equipment such as plants. For example, JP 2015-190364 discloses a generator device (thermal energy recovery device) including a heater, an expander, a generator, a condenser, a circulation pump, a circulation flow path connecting an evaporator, the expander, the condenser, and the circulation pump in this order, a cooling passage, and a cooling valve provided in the cooling passage.

The heater evaporates working medium. The expander expands working medium flowing out of the evaporator. The generator is driven by the expander to generator electric power. The condenser condenses working medium flowing out of the expander. The circulation pump delivers working medium flowing out of the condenser to the heater. The cooling passage connects a site downstream the circulation pump in the circulation flow path and a site downstream the heater in the circulation flow path such that working medium of liquid phase discharged from the circulation pump is partially supplied to a site of the circulation flow path between the heater and the expander. This causes working medium flowing out of the heater to be cooled by the working medium of liquid phase supplied through the cooling passage. A shutoff valve is also provided at a site of the circulation flow path between the heater and the expander.

The thermal energy recovery device has a control unit for controlling the cooling valve during operation such that the working medium at the site of the circulation flow path between the heater and the expander is in an overheated state and the temperature of the working medium at the site cannot exceed a reference temperature. Accordingly, the working medium is inhibited from flowing into the expander in a gas-liquid two-phase state and the site of the circulation flow path between the heater and the expander is avoided having high temperature (no heat-resistant member is required to be used for the shutoff valve, the flange packing, or the like).

In the generator device described in JP 2015-190364, the site of the circulation flow path between the heater and the expander is avoided having too high temperature during steady operation, but no countermeasure is mentioned to the site having too high temperature upon stoppage of the device, that is, after the control unit receives a stop signal for stopping the expander and the generator and before the expander, the generator, and the pump are completely stopped.

It is hence an object of the present invention to provide a thermal energy recovery device in which a site of a circulation flow path between an evaporated portion and an expander can be avoided having too high temperature upon stoppage of power recovery by a power recovery machine.

In order to achieve the foregoing object, the present invention provides a thermal energy recovery device including an evaporator for evaporating working medium, an expander for expanding working medium flowing out of the evaporator, a power recovery machine connected to the expander, a condenser for condensing working medium flowing out of the expander, a pump for delivering working medium flowing out of the condenser to the evaporator, a circulation flow path connecting the evaporator, the expander, the condenser, and the pump in this order, a cooling flow path for supplying working medium of liquid phase flowing out of the pump partially to a site of the circulation flow path between the evaporator and the expander, an on-off valve provided in the cooling flow path, and a control unit, in which upon reception of a stop signal for stopping power recovery by the power recovery machine, the control unit opens the on-off valve.

In the thermal energy recovery device, upon reception of a stop signal for stopping power recovery by the power recovery machine, the control unit opens the on-off valve, whereby after the power recovery machine comes into a stop operation (the rotational speed of the power recovery machine starts decreasing), working medium of gas phase flowing out of the evaporator is cooled effectively by working medium of liquid phase supplied through the cooling flow path. Accordingly, the site of the circulation flow path between the evaporator and the expander can be avoided having too high temperature upon stoppage of power recovery by the power recovery machine.

In the case above, after opening the on-off valve, the control unit preferably reduces the rotational speed of the pump such that the temperature of the site of the circulation flow path between the evaporator and the expander is kept at a reference temperature or lower.

This causes the power recovery machine and the pump to be stopped while the site is inhibited from having too high temperature.

As described heretofore, in accordance with the present invention, it is possible to provide such a thermal energy recovery device in which a site of a circulation flow path between an evaporated portion and an expander can be avoided having too high temperature upon stoppage of power recovery by a power recovery machine.

DESCRIPTION OF THE PREFERRED EMBODIMENTS

A thermal energy recovery system according to an embodiment of the present invention will hereinafter be described with reference to FIGS. 1 and 2.

Figure 1:
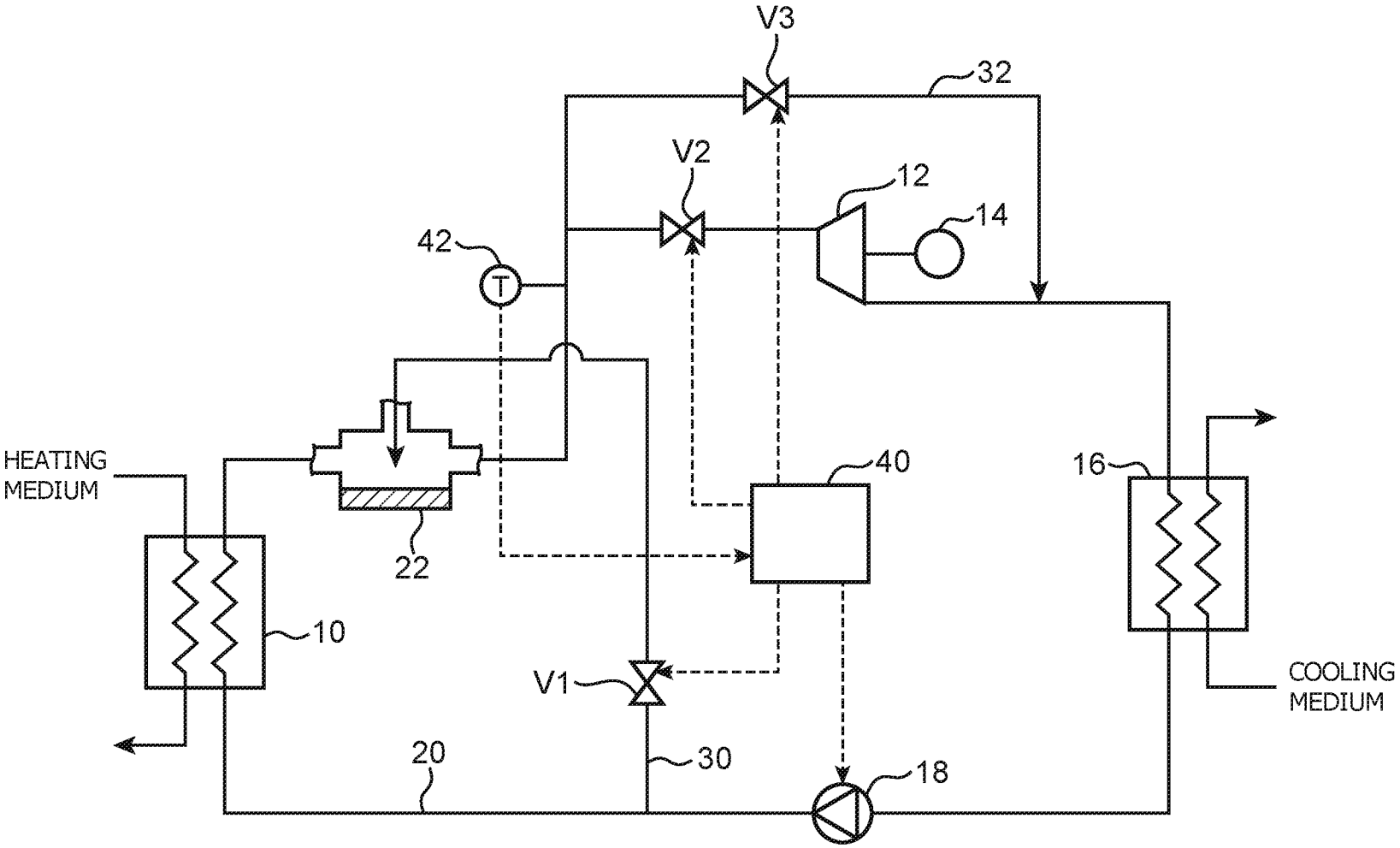
FIG. 1 is a schematic view showing the configuration of a thermal energy recovery device according to an embodiment of the present invention.
Figure 2:
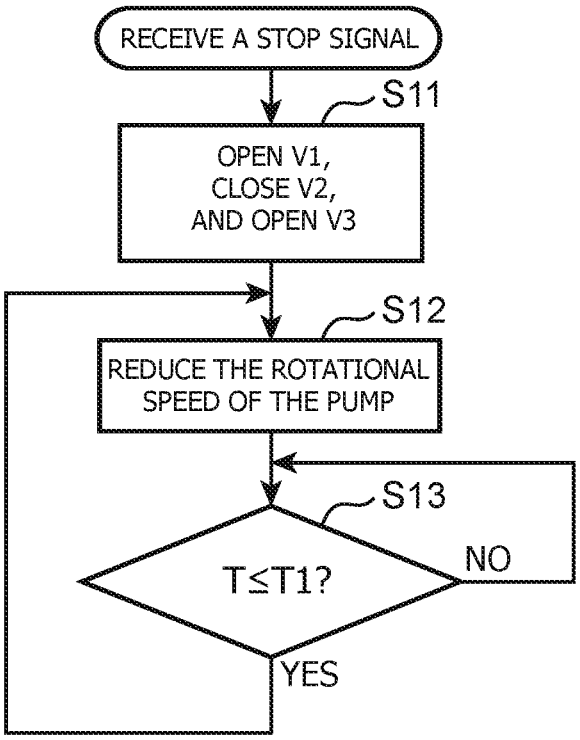
FIG. 2 is a flow chart showing control details by a control unit.

As shown in FIG. 1 the thermal energy recovery system includes an evaporator 10, an expander 12, a power recovery machine 14, a condenser 16, a pump 18, a circulation flow path 20 connecting the evaporator 10, the expander 12, the condenser 16, and the pump 18 in this order, a cooling flow path 30, and a control unit 40.

The evaporator 10 evaporates working medium through heat exchange between the working medium and heating medium.

The expander 12 is provided at a site downstream the evaporator 10 in the circulation flow path 20. The expander 12 expands working medium of gas phase flowing out of the evaporator 10. In this embodiment, the expander 12 employs a volumetric screw expander having a rotor to be rotationally driven by the expansion energy of working medium of gas phase.

The power recovery machine 14 is connected to the expander 12. In this embodiment, the power recovery machine 14 employs a generator. The power recovery machine 14 has a rotating shaft connected to the rotor of the expander 12. The power recovery machine 14 generates electric power when the rotating shaft rotates with the rotation of the rotor. It is noted that the power recovery machine 14 may employ a compressor or the like.

The condenser 16 is provided at a site downstream the expander 12 in the circulation flow path 20. The condenser 16 condenses working medium flowing out of the expander 12 through heat exchange between the working medium and cooling medium (e.g. cooling water).

The pump 18 is provided at a site downstream the condenser 16 (between the condenser 16 and the evaporator 10) in the circulation flow path 20. The pump 18 delivers working medium of liquid phase flowing out of the condenser 16 to the evaporator 10 at a predetermined pressure.

The cooling flow path 30 connects a site downstream the pump 18 in the circulation flow path 20 and a site downstream the evaporator 10 in the circulation flow path 20 such that working medium of liquid phase discharged from the pump 18 is partially supplied to a site of the circulation flow path 20 between the evaporator 10 and the expander 12. In this embodiment, the circulation flow path 20 has a cooled portion 22 formed between the evaporator 10 and the expander 12, and a downstream end portion of the cooling flow path 30 is connected to an upper part of the cooled portion 22. Accordingly, working medium of liquid phase discharged from the pump 18 is partially supplied into the cooled portion 22 through the cooling flow path 30. This allows working medium of gas phase flowing out of the evaporator 10 to be cooled effectively in the cooled portion 22. The cooled portion 22 has a diameter greater than that of any other site of the circulation flow path 20 between the evaporator 10 and the expander 12. It is noted that FIG. 1 shows a state where working medium of liquid phase is reserved in a lower part of the cooled portion 22.

The thermal energy recovery device of this embodiment further includes an on-off valve V1 provided in the cooling flow path 30 with an adjustable opening, a shutoff valve V2 provided at a site in the circulation flow path 20 between the cooled portion 22 and the expander 12, a bypass flow path 32 for bypassing the shutoff valve V2 and the expander 12, and a bypass valve V3 provided in the bypass flow path 32. The valves V1 to V3 are arranged openable and closable. It is noted that the shutoff valve V2 is opened and the bypass valve V3 is closed during steady operation of the thermal energy recovery device.

During recovery of power (electric power in this embodiment) by the power recovery machine 14 (when the expander 12, the power recovery machine 14, and the pump 18 are driven), upon reception of a stop signal for stopping the power recovery by the power recovery machine 14, the control unit 40 starts cooling the cooled portion 22, that is, supplying working medium of liquid phase discharged from the pump 18 partially to the cooled portion 22 through the cooling flow path 30. The control unit 40 then reduces the rotational speed of the pump 18 such that the temperature of the site of the circulation flow path 20 between the evaporator 10 and the expander 12 is kept at a reference temperature T1 or lower. It is noted that the stop signal means, for example, a signal sent to the control unit 40 when an operator performs an operation of stopping the device or a signal indicating an abnormality of the power recovery machine 14 (generator in this embodiment). Control details by the control unit 40 will hereinafter be described with reference to FIG. 2.

Upon reception of the stop signal, the control unit 40 opens the on-off valve V1, closes the shutoff valve V2, and opens the bypass valve V3 (step S11). This causes working medium of liquid phase discharged from the pump 18 to be supplied partially to the cooled portion 22 and thereby working medium of gas phase flowing out of the evaporator 10 to be cooled effectively in the cooled portion 22. Also, the working medium cooled in the cooled portion 22 runs through the bypass flow path 32 to the condenser 16. It is noted that the rotational speed of the expander 12 and the power recovery machine 14 may be reduced in or prior to step S11.

The control unit 40 then reduces the rotational speed of the pump 18 (step S12). This causes the flow rate of working medium of liquid phase supplied to the cooled portion 22 through the cooling flow path 30 (the cooling rate in the cooled portion 22) to decrease. On the other hand, while heating medium continues to be supplied to the evaporator 10, working medium of liquid phase existing within the evaporator 10 continues to be evaporated and working medium of gas phase flowing out of the evaporator 10 continues to flow into the cooled portion 22, which may cause the temperature T of the site of the circulation flow path 20 between the evaporator 10 and the expander 12 to rise. It is noted that the temperature T is detected by a temperature sensor 42 provided at a site of the circulation flow path 20 between the cooled portion 22 and the shutoff valve V2.

In this embodiment, after reducing the rotational speed of the pump 18 (after step S12), the control unit 40 then determines whether or not the temperature T of the site of the circulation flow path 20 between the evaporator 10 and the expander 12 is equal to or lower than the reference temperature T1 (e.g. 130 degrees C.) (step S13).

If this results in that the temperature T is equal to or lower than the reference temperature T1, the control unit 40 returns to step S12, that is, further reduce the rotational speed of the pump 18. This causes the pump 18 to be stopped stably while the temperature T of the site is kept at the reference temperature T1. It is noted that if NO in step S13, the control unit 40 returns to step S13 again.

As described heretofore, in the thermal energy recovery device, upon reception of a stop signal for stopping power recovery by the power recovery machine 14, the control unit 40 opens the on-off valve V1, whereby after the power recovery machine 14 comes into a stop operation (the rotational speed of the power recovery machine 14 starts decreasing), working medium of gas phase flowing out of the evaporator 10 is cooled effectively by working medium of liquid phase supplied through the cooling flow path 30. Accordingly, the site of the circulation flow path 20 between the evaporator 10 and the expander 12 can be avoided having too high temperature upon stoppage of power recovery by the power recovery machine 14. It is therefore not necessary to use a heat-resistant member for the packing of the shutoff valve V2 or the bypass valve V3.

Further, since after opening the on-off valve V1, the control unit 40 reduces the rotational speed of the pump 18 such that the temperature T is kept at the reference temperature T1 or lower, the power recovery machine 14 and the pump 18 are stopped while the site is inhibited from having too high temperature.

It is noted that the above-disclosed embodiment should be construed as illustrative only and not restrictive in all aspects. The scope of the present invention is defined not by the above-described embodiment but by the appended claims and further includes all modifications within the meaning and scope equivalent to the appended claims.

For example, the cooled portion 22 may have the same diameter as that of any other site of the circulation flow path 20 between the evaporator 10 and the expander 12.

What is claimed is:

1. A thermal energy recovery device comprising:

an evaporator for evaporating working medium;

an expander for expanding working medium flowing out of the evaporator;

a power recovery machine connected to the expander;

a condenser for condensing working medium flowing out of the expander;

a pump for delivering working medium flowing out of the condenser to the evaporator;

a circulation flow path connecting the evaporator, the expander, the condenser, and the pump in this order;

a cooling flow path for supplying working medium of liquid phase flowing out of the pump partially to a site of the circulation flow path between the evaporator and the expander;

an on-off valve provided in the cooling flow path; and a control unit, wherein upon reception of a stop signal for stopping power recovery by the power recovery machine, the control unit opens the on-off valve while maintaining an operation of the pump delivering working medium flowing out of the condenser to the evaporator.

2. The thermal energy recovery device according to claim 1, wherein after opening the on-off valve, the control unit reduces the rotational speed of the pump such that the temperature of the site of the circulation flow path between the evaporator and the expander is kept at a reference temperature or lower.

3. The thermal energy recovery device according to claim 1, further comprising a cooled portion provided in the circulating flow path between the evaporator and the expander in such a manner that working medium of liquid phase discharged from the pump is partially supplied into the cooled portion when the on-off valve is opened.

4. The thermal energy recovery device according to claim 3, wherein the cooled portion has a diameter greater than that of any other site of the circulation flow path between the evaporator and the expander.

* * * * *